US007331137B2

(12) United States Patent
Hsu

(10) Patent No.: US 7,331,137 B2
(45) Date of Patent: Feb. 19, 2008

(54) LASER POINTER AS AUXILIARY SIGHT OF FIREARM

(76) Inventor: Yao-Hsi Hsu, 1F, No. 235, Tayou Rd., Sungshan Chiu, Taipei 105 (TW)

( * ) Notice: Subject to any disclaimer, the term of this patent is extended or adjusted under 35 U.S.C. 154(b) by 0 days.

(21) Appl. No.: 10/612,136

(22) Filed: Jul. 3, 2003

(65) Prior Publication Data

US 2007/0240355 A1 Oct. 18, 2007

(51) Int. Cl.
*F41G 1/00* (2006.01)
*F41G 1/28* (2006.01)

(52) U.S. Cl. ..... 42/114; 42/115

(58) Field of Classification Search ..... 42/114, 42/115, 124, 125, 126
See application file for complete search history.

(56) References Cited

U.S. PATENT DOCUMENTS 3,813,790 A * 6/1974 Kaltmann ..... 42/132
3,867,764 A * 2/1975 Dunmire et al. ..... 42/115
4,026,054 A * 5/1977 Snyder ..... 42/115
4,233,770 A * 11/1980 de Filippis et al. ..... 42/114
4,313,272 A * 2/1982 Matthews ..... 42/115
4,742,636 A * 5/1988 Swan ..... 42/126
4,939,863 A * 7/1990 Alexander et al. ..... 42/115
5,323,555 A * 6/1994 Jehn ..... 42/115
5,351,429 A * 10/1994 Ford ..... 42/115
5,355,609 A * 10/1994 Schenke ..... 42/115
5,433,010 A * 7/1995 Bell ..... 42/126
5,581,898 A * 12/1996 Thummel ..... 42/117
5,685,636 A * 11/1997 German ..... 362/259
5,694,713 A * 12/1997 Paldino ..... 42/115
5,704,155 A * 1/1998 Primeau, IV ..... 42/114
5,784,823 A * 7/1998 Chen ..... 42/115

FOREIGN PATENT DOCUMENTS

WO WO88/07168 * 9/1988

* cited by examiner

*Primary Examiner*—Bret Hayes
(74) *Attorney, Agent, or Firm*—Troxell Law Office, PLLC

(57) ABSTRACT

A laser pointer on a seat of a firearm as an auxiliary sight is disclosed. The pointer comprises a cylindrical housing comprising a forward aperture; a light emitting mechanism in the housing, the mechanism being adapted to emit laser beam through the aperture to impinge on a target; and an adjustment ring rotatably put on the housing, the adjustment ring comprising an outer knurled ring, and an inner cam ring comprising an outer projection secured to the knurled ring, an eccentric bore for receiving a rear portion of the mechanism, and a rear narrow shoulder as a stop. A firearm user can rotate the adjustment ring to adjust the laser beam direction and thus the light spot on the target. The corrected adjustment ring can be fastened. Hence, the invention can aid the eyes to quickly line up the firearm on the target.

5 Claims, 6 Drawing Sheets

LASER POINTER AS AUXILIARY SIGHT OF FIREARM

BACKGROUND OF THE INVENTION

1. Field of the Invention

The present invention relates to laser pointers and more particularly to a laser pointer used as an auxiliary sight of firearm (e.g., rifle) for aiding the eyes to quickly aim at a target.

2. Description of Related Art

A conventional laser pointer 50 is a battery operated, lightweight device as shown in FIG. 1. The laser pointer 50 comprises a front, internal light emitting mechanism 51 capable of emitting a laser beam on an objective. The prior laser pointer 50 is mounted on a seat of a firearm (e.g., rifle) for aiding the eyes to aim at a target. The laser pointer 50 is designed to be adjustable so that the laser beam emitted from the light emitting mechanism 51 can aid the eyes to line up the rifle on its target. The adjustment of the light emitting mechanism 51 is described below by referring to FIG. 2. A plurality of screws 52 are provided at a rear portion of the light emitting mechanism 51. Each screw 52 is driven from an outer surface of a cylindrical housing 53 of the laser pointer 50 inside to contact the light emitting mechanism 51. The position of the light emitting mechanism 51 inside the laser pointer 50 can be adjusted by suitably driving the screws 52 different depths or the same depth in the housing 53. Accordingly, the laser beam direction and a light spot of the laser beam on the target can be changed.

However, the prior art suffered from a disadvantage. For example, changes of both the laser beam in a horizontal direction and/or a vertical direction and thus the light spot are done by adjusting the plurality of screws 52 one by one. It is time consuming and tedious. Hence, a need for improvement exists.

SUMMARY OF THE INVENTION

It is an object of the present invention to provide a laser pointer mounted on a seat of a firearm as an auxiliary sight, comprising a cylindrical housing comprising a forward aperture; a light emitting mechanism within the housing, the light emitting mechanism having a forward end fastened in the housing, the light emitting mechanism being adapted to emit laser beam through the aperture to impinge on a target; and an adjustment ring rotatably put on the housing, the adjustment ring comprising an outer knurled ring having a hole to permit a positioning fastener to drive through to urge the housing for fastening the corrected adjustment ring, and an inner cam ring comprising a projection on its outer surface to permit a fastener to drive through to threadedly secure to the knurled ring, an eccentric bore with a rear portion of the light emitting mechanism received therein, and a rear narrow shoulder as a stop. In operation, a rifle user can rotate the adjustment ring to adjust the laser beam direction and thus the light spot of the laser beam on the target. As such, it is possible of aiding the eyes to quickly line up the firearm on the target by only firing one or several shots.

The above and other objects, features and advantages of the present invention will become apparent from the following detailed description taken with the accompanying drawings.

DETAILED DESCRIPTION OF THE PREFERRED EMBODIMENTS

Figure 1:
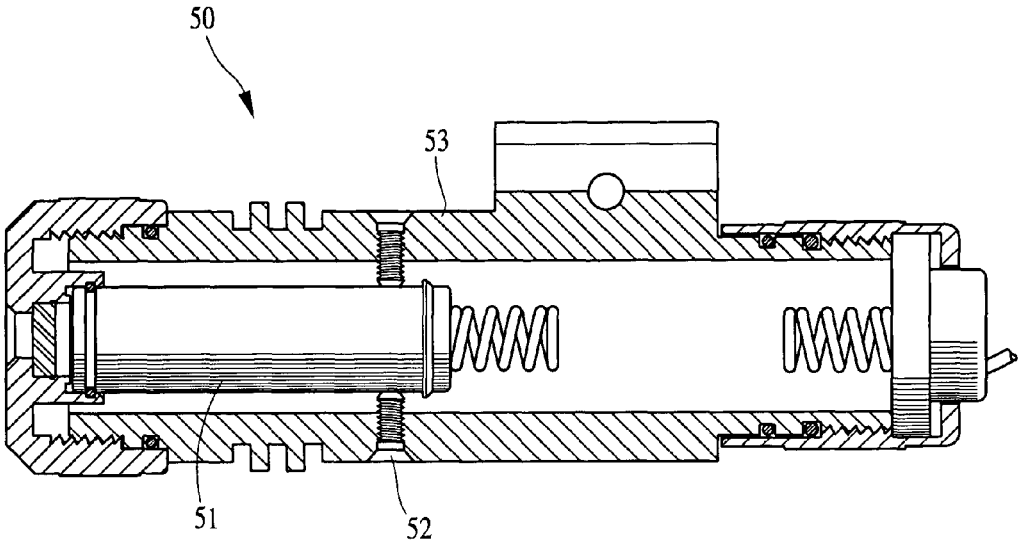
FIG 1 PRIOR ART
FIG. 1 is a cross-sectional view of a conventional laser pointer as an auxiliary sight of firearm.
Figure 2:
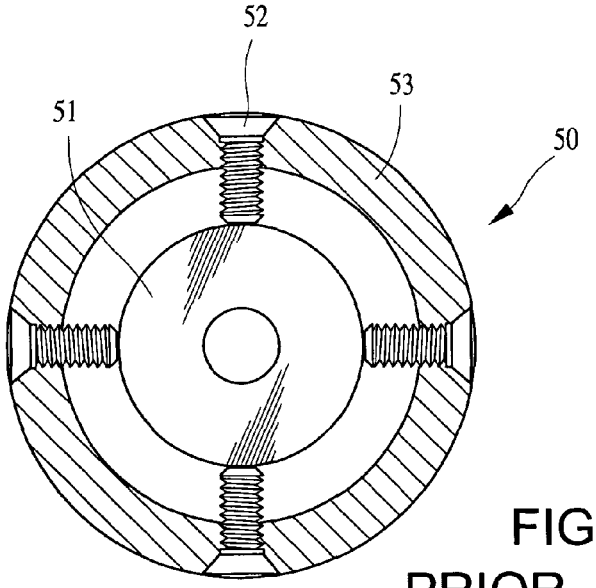
FIG.2 PRIOR ART
FIG. 2 is another cross-sectional view of the rear portion of a light emitting mechanism of the FIG. 1 laser pointer illustrating position adjustment of the light emitting mechanism by means of four screws.
Figure 3:
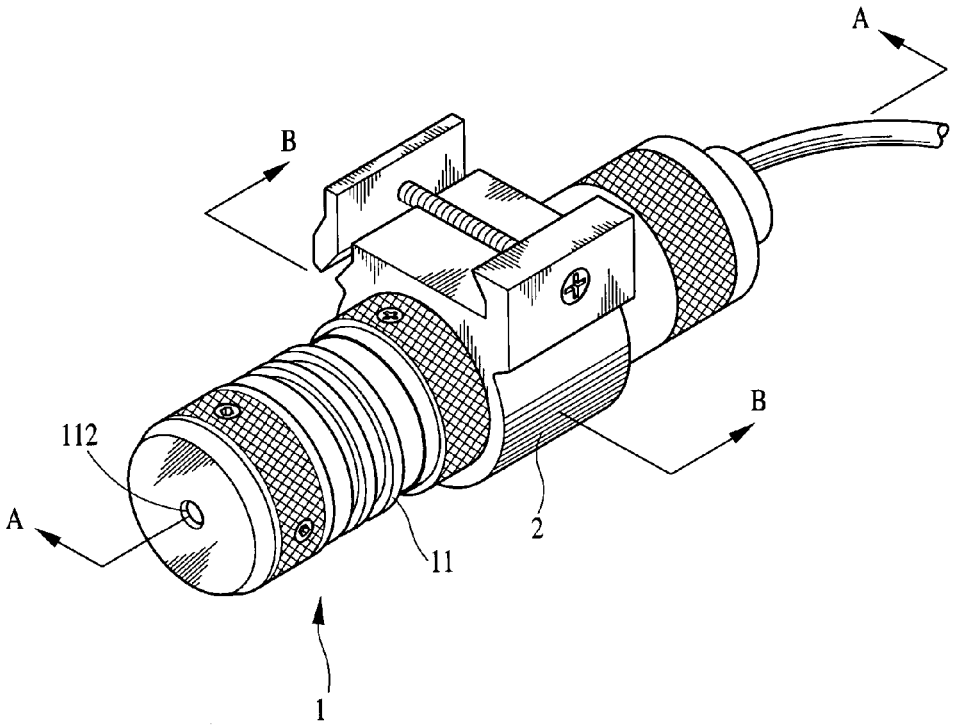
FIG. 3 is a perspective view of a preferred embodiment of laser pointer mounted on a seat of a firearm according to the invention.
Figure 4:
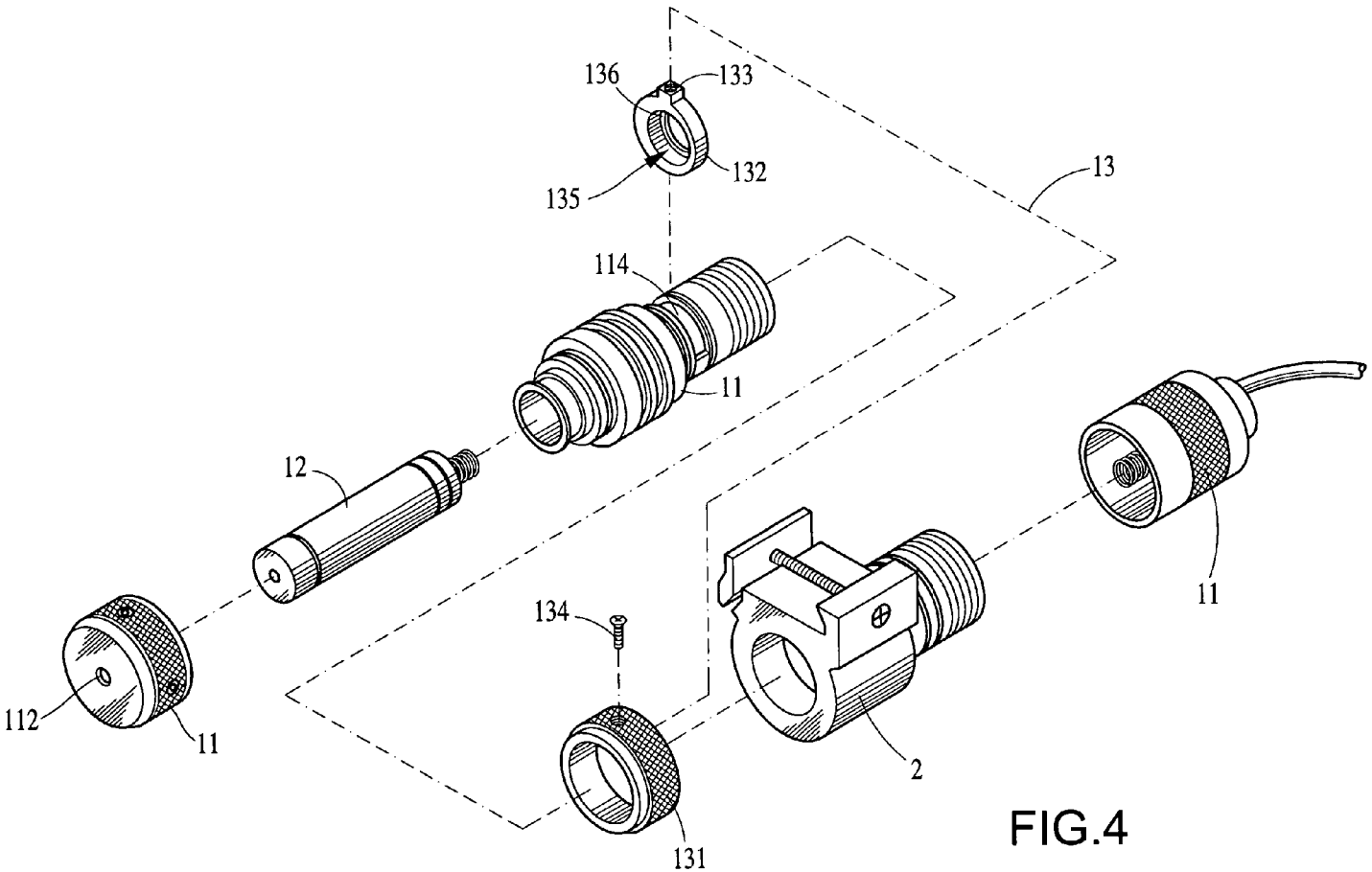
FIG. 4 is an exploded view of FIG. 3.
Figure 5:
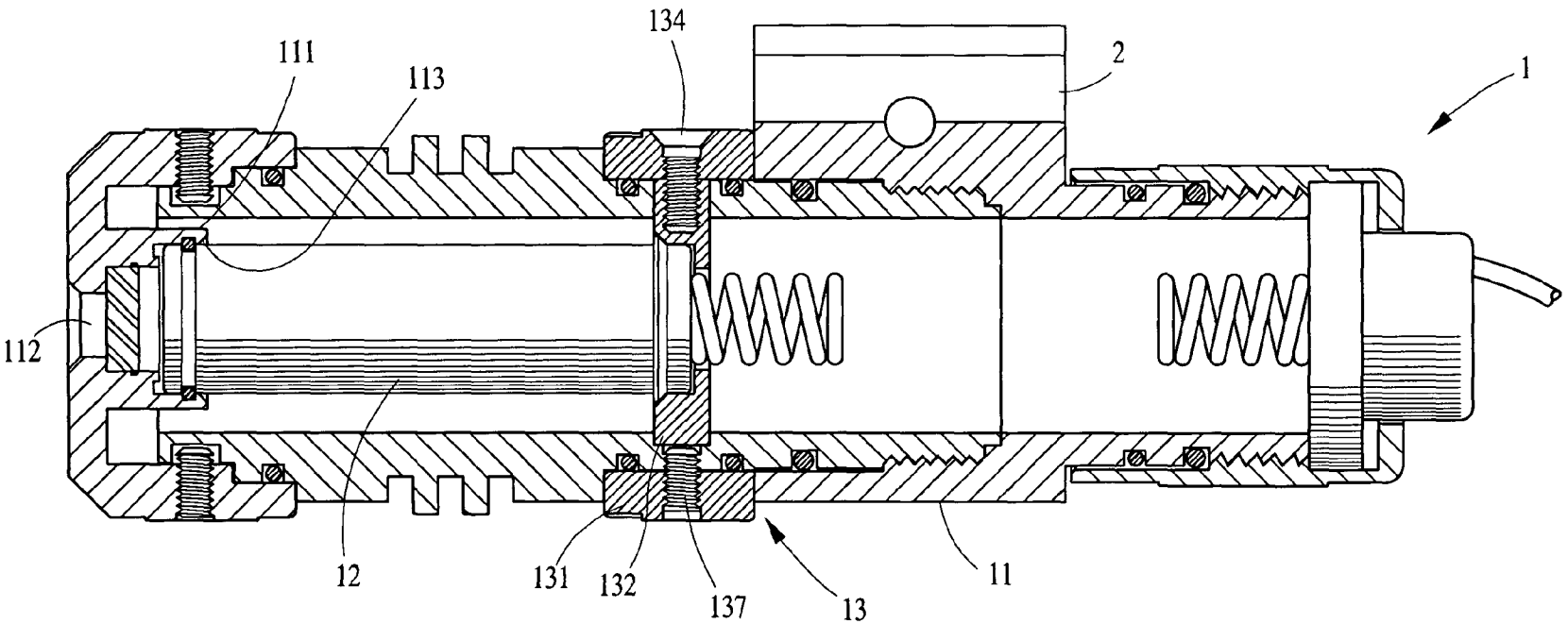
FIG. 5 is a cross-sectional view taken along line A-A of the FIG. 3.

Referring to FIGS. 3, 4 and 5, a cylindrical laser pointer 1 constructed in accordance with the invention is shown. The laser pointer 1 is used as an auxiliary sight of a front sight of firearm (e.g., rifle). The laser pointer 1 comprises a housing 11 having an internal space for receiving a light emitting mechanism 12 and a cell (not shown) for supplying electrical energy to the light emitting mechanism 12 to emit light (e.g., laser beam in the embodiment) on an objective. A front end of the light emitting mechanism 12 is fastened in a bore 111 of the housing 11. Laser beam emitted from the front end of the light emitting mechanism 12 passes through a front aperture 112 of the housing 11. An interior cavity 113 of the housing 11 is formed to provide an allowance in adjusting the position of the light emitting mechanism 12 and thus the laser beam direction.

An adjustment ring 13 is provided at an intermediate section of the housing 11. In detail, the adjustment ring 13 is put on the housing 11 and is rotatable thereabout. The adjustment ring 13 comprises an outer knurled ring 131 and an inner cam ring 132 put on an annular groove 114 of the housing 11. The cam ring 132 comprises a holed projection 133 on its outer surface so that a screw 134 or any of other suitable fasteners can be employed to drive through a hole of the knurled ring 131 into the projection 133 for fastening the knurled ring 132 and the cam ring 131 together.

Figure 6:
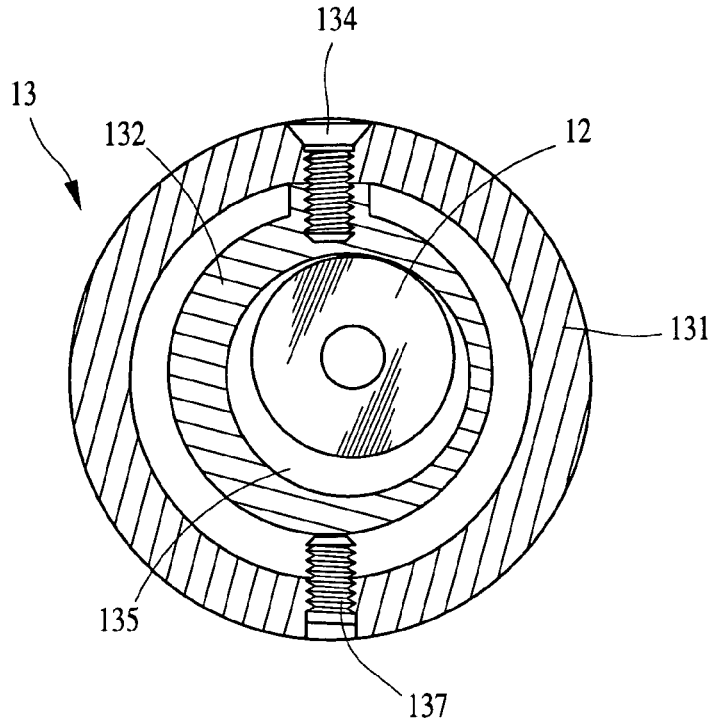
FIG. 6 is a cross-sectional view taken along line B-B of the FIG. 3.

Referring to FIG. 6 in conjunction with FIG. 4, the cam ring 132 further comprises an eccentric bore 135 with a rear portion of the light emitting mechanism 12 received therein. Further, the light emitting mechanism 12 is held in place inside the housing 11 by the cam ring 131 and the bore 111. The cam ring 132 further comprises a narrow shoulder 136 at its rear end to prevent the light emitting mechanism 12 from passing through the rear end of the cam ring 132 to disengage from the bore 111.

Figure 7:
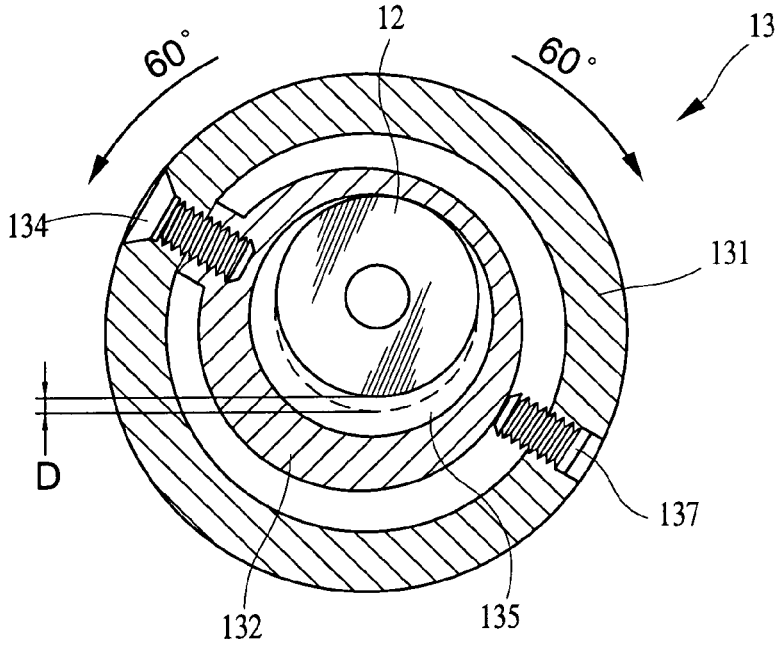
FIG. 7 is a cross-sectional view similar to FIG. 6 for illustrating position adjustment of a light emitting mechanism of the laser pointer according to the invention.

Referring to FIG. 7 in conjunction with FIG. 6, a rotation (e.g., 60 degrees either clockwise or counterclockwise) of the adjustment ring 13 (i.e., the knurled ring 131) causes the light emitting mechanism 12 to move laterally in the eccentric bore 135 (as indicated by distance D). As a result, the laser beam direction of the light emitting mechanism 12 can be changed.

Figure 8:
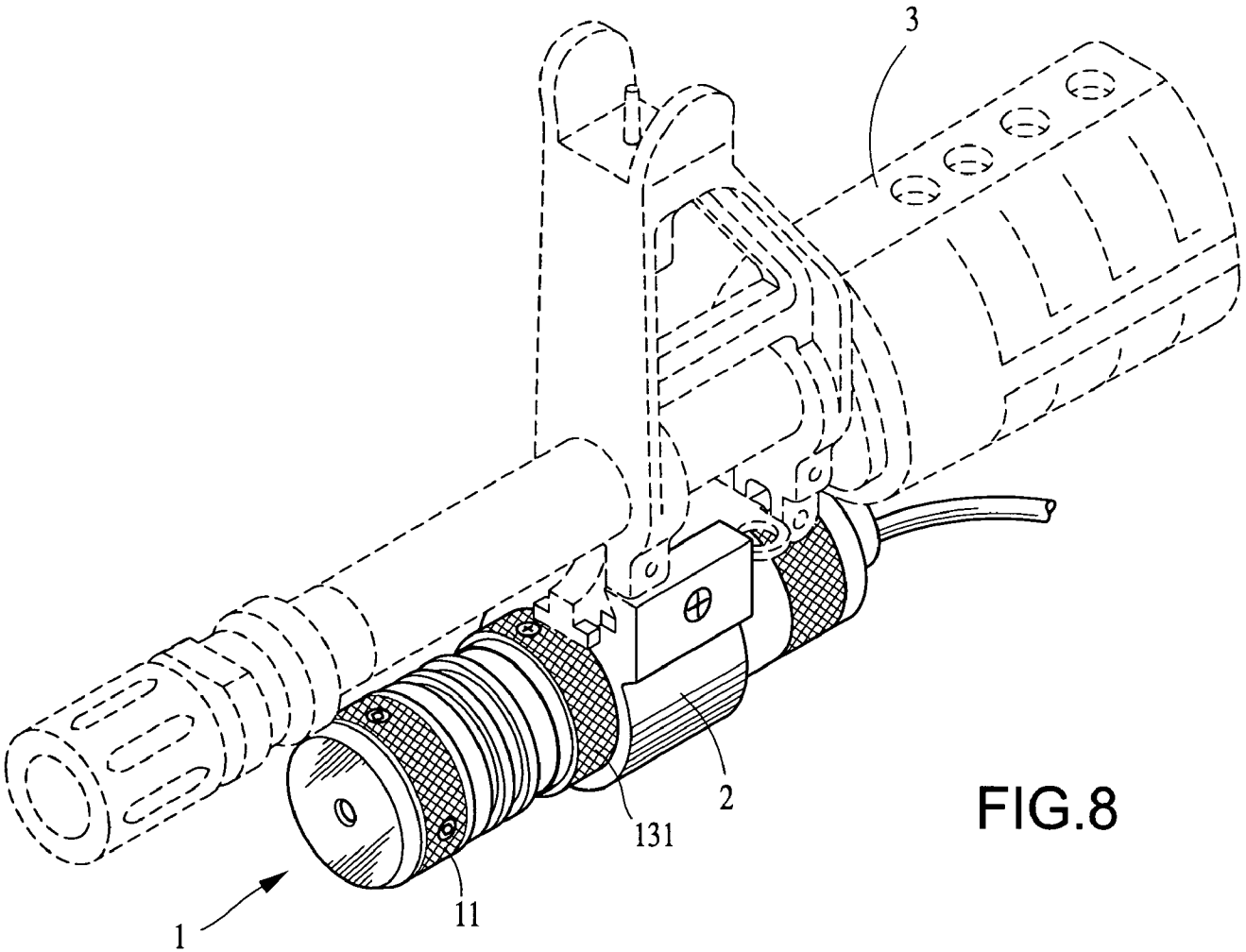
FIG. 8 is an environmental view of the laser pointer mounted on a rifle as an auxiliary sight of the rifle.

Referring to FIG. 8, the laser pointer 1 is mounted on a seat 2 of rifle 3 as an auxiliary sight of a front sight of the rifle 3. In operation, a rifle user can rotate the adjustment ring 13 to adjust the laser beam direction of the light emitting mechanism 12 and thus the light spot of the laser beam on a target. As such, it is possible of aiding the eyes to quickly line up the rifle 2 on the target by only firing one or several shots. Moreover, the corrected adjustment ring 13 can be fastened by simply driving a positioning screw 137 through the knurled ring 131 to secure to the housing 11.

While the invention herein disclosed has been described by means of specific embodiments, numerous modifications and variations could be made thereto by those skilled in the art without departing from the scope and spirit of the invention set forth in the claims.

What is claimed is:

1. A laser pointer mounted on a seat of a firearm as an auxiliary sight, comprising:

a cylindrical housing comprising a forward aperture;

a light emitting mechanism within the housing, the light emitting mechanism having a forward end fastened in the housing, the light emitting mechanism being adapted to emit light through the aperture to impinge on a target; and an adjustment ring rotatably put on the housing, the adjustment ring comprising an eccentric bore with a rear portion of the light emitting mechanism received therein, wherein the adjustment ring is configured to be rotated to move the light emitting mechanism laterally a distance.

2. The laser pointer of claim 1, wherein the adjustment ring further comprises a positioning fastener therethrough urged the housing for fastening the corrected adjustment ring.

3. The laser pointer of claim 1, wherein the adjustment ring further comprises a rear narrow shoulder.

4. The laser pointer of claim 1, wherein the housing further comprises a bore for fastening the light emitting mechanism.

5. The laser pointer of claim 1, wherein the adjustment ring further comprises an outer knurled ring put on the housing, and an inner cam ring put on the housing, the cam ring comprising a projection on its outer surface secured to the knurled ring.

* * * * *